US010071408B2

(12) United States Patent
Hanada

(10) Patent No.: US 10,071,408 B2
(45) Date of Patent: Sep. 11, 2018

(54) PRECURSOR DETECTION METHOD AND PRECURSOR DETECTION DEVICE OF STICK-SLIP PHENOMENON, AND METHOD FOR COLD-DRAWING PIPE OR TUBE USING PRECURSOR DETECTION METHOD

(71) Applicant: NIPPON STEEL & SUMITOMO METAL CORPORATION, Tokyo (JP)

(72) Inventor: Takuya Hanada, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 937 days.

(21) Appl. No.: 14/398,782

(22) PCT Filed: May 2, 2013

(86) PCT No.: PCT/JP2013/062751
§ 371 (c)(1),
(2) Date: Nov. 4, 2014

(87) PCT Pub. No.: WO2013/172208
PCT Pub. Date: Nov. 21, 2013

(65) Prior Publication Data

US 2015/0082851 A1 Mar. 26, 2015

(30) Foreign Application Priority Data

May 16, 2012 (JP) ..... 2012-112342

(51) Int. Cl.
*B21C 1/24* (2006.01)
*B21C 51/00* (2006.01)

(52) U.S. Cl.
CPC ..... *B21C 51/00* (2013.01); *B21C 1/24* (2013.01)

(58) Field of Classification Search
CPC ..... B21C 1/24
See application file for complete search history.

(56) References Cited

FOREIGN PATENT DOCUMENTS

| | | | |
|---|---|---|---|
| JP | 50-1956 | | 1/1975 |
| JP | 50-007764 | | 1/1975 |
| JP | 50001956 B | * | 1/1975 |
| JP | 53-054164 | | 5/1978 |
| JP | 1-170513 | | 7/1989 |
| JP | 10-225712 | | 8/1998 |

(Continued)

*Primary Examiner* — Debra Sullivan
(74) *Attorney, Agent, or Firm* — Clark & Brody

(57) ABSTRACT

A precursor detection device 6 detects a precursor of a stick-slip phenomenon in a drawing machine 1. The precursor detection device 6 includes a load measurement section 61 for measuring a load applied to a plug support bar 4 in the drawing direction, a precursor detection section 62 for detecting a precursor of a stick-slip phenomenon based on a load measurement value measured by the load measurement section 61, and a control section 63. After drawing is started, a load applied to the plug support bar 4 in the drawing direction is measured by the load measurement section 61 during a predetermined period from a measurement start point to a measurement end point, and based on the measured load measurement values, a precursor of a stick-slip phenomenon is detected by the precursor detection section 62.

3 Claims, 5 Drawing Sheets

(56) References Cited

FOREIGN PATENT DOCUMENTS

| | | | | | |
|---|---|---|---|---|---|
| JP | 10225712 | A | * | 8/1998 | |
| JP | 2004-034147 | | | 2/2004 | |
| JP | 2011-174765 | | | 9/2011 | |
| SU | 1315063 | A | * | 6/1987 | ..... B21C 1/24 |

* cited by examiner

PRECURSOR DETECTION METHOD AND PRECURSOR DETECTION DEVICE OF STICK-SLIP PHENOMENON, AND METHOD FOR COLD-DRAWING PIPE OR TUBE USING PRECURSOR DETECTION METHOD

TECHNICAL FIELD

The present invention relates to a precursor detection method and a precursor detection device of a stick-slip phenomenon, and a method for cold drawing a pipe or tube (hereinafter referred to as "pipe" when deemed appropriate) by using the precursor detection method.

BACKGROUND ART

Conventionally, as a method for machining a pipe such as a steel pipe into a smaller diameter pipe, a cold drawing work has been practiced, in which a pipe is drawn through a die with a plug being inserted into the pipe. When drawing work of a pipe is performed with a drawing machine, a stick-slip phenomenon may occur during drawing due to the mechanism of such machining.

The stick-slip phenomenon will be described with reference to FIG. 1.

A plug 3, which is inserted into a pipe T, is provided at a front edge of a plug support bar 4, and a rear edge of the plug support bar 4 is fixed on a base of a drawing machine. During drawing, a carriage (not shown) attached to the front edge of the pipe T pulls the pipe T in the drawing direction. At this moment, the plug 3 is pulled by friction force generated between itself and the inner surface of the pipe T, thereby being moved in the drawing direction integrally with the pipe T. When the plug 3 is pulled and moved in the drawing direction, the plug support bar 4 stretches in the drawing direction since the rear edge of the plug support bar 4 is fixed on the base of the drawing machine. Accordingly, on account of a contractive force due to the elasticity of the plug support bar 4, the plug 3 is subject to a force to pull it back to the opposite side (the plug support bar 4 side) in the drawing direction. As the moved distance of plug 3 in the drawing direction increases, the contractive force due to the elasticity of the plug support bar 4 increases as well so that the force to pull back the plug 3 increases. When the force to pull back the plug 3 becomes larger than the friction force generated between the inner surface of the pipe T and the plug 3, slip occurs between the plug 3 and the inner surface of the pipe T so that the plug 3 is pulled back to the plug support bar 4 side. When the plug 3 is pulled back and thereby the contractive force of the plug support bar 4 decreases, the plug 3 is again pulled by the pipe T to be moved in the drawing direction. In this way, the movement of the plug 3 in the drawing direction and the pulling back thereof to the plug support bar 4 side are repeated so that the plug 3 vibrates along the drawing direction. The stick-slip phenomenon is a phenomenon in which the plug 3 significantly vibrates along the drawing direction due to the friction and slipping between the plug 3 and the pipe T during drawing, thereby generating a sound. This stick-slip phenomenon is likely to occur when the drawing speed is large or when the lubricity between the pipe and the plug is deficient.

Occurrence of such a stick-slip phenomenon will result in dimensional defects in which the outer diameter and inner diameter dimensions of the pipe after drawing vary in the longitudinal direction of the pipe. When the stick-slip phenomenon is significant, not only dimensional defects but also crack flaws will occur.

Since the occurrence of a stick-slip phenomenon leads to the generation of sound attributable to vibration of the plug etc., the operator reduces the drawing speed upon hearing the sound of a stick-slip phenomenon during drawing. Thus, for subsequent pipes in the same lot, drawing is performed at a speed not more than the reduced drawing speed, thereby preventing the occurrence of a stick-slip phenomenon. However, as the result of being too much concerned about the occurrence of a stick-slip phenomenon, there is a risk that the drawing speed is reduced more than necessary, and if so, the manufacturing efficiency will be reduced.

Moreover, since the detection of a stick-slip phenomenon relies on the auditory sense of the operator, the accuracy of the detection is not sufficient. Furthermore, since there is difference in the detectability between operators, there is a risk that the reaction such as reducing the drawing speed may be delayed when a stick-slip phenomenon occurs. For this reason, conventionally, there have been proposed various methods for detecting such a stick-slip phenomenon as described above without relying on the auditory sense of the operator.

For example, there is proposed a drawing method in which an AE sensor is attached to a die and it is judged that a stick-slip phenomenon has occurred upon detection of a vibration of a predetermined frequency (refer to Patent Literature 1).

Moreover, there is proposed a detection method in which the strain of a carriage which pulls the pipe is measured, and the occurrence of a stick-slip phenomenon is judged from the result of frequency analysis of the amount of change in the strain (refer to Patent Literature 2).

As described so far, the occurrence of a stick-slip phenomenon can be detected at a tolerable level by a method in which the operator makes judgment based on sound as described above, as well as the methods of Patent Literatures 1 and 2. However, since the dimensional defects of the pipe have already occurred at the time when a stick-slip phenomenon occurs, it is desirable to detect a precursor of the stick-slip phenomenon (hereafter, a precursor of a stick-slip phenomenon is also abbreviated simply as a precursor) in a stage prior to the occurrence of a stick-slip phenomenon. Detecting a precursor and reducing the drawing speed before a stick-slip phenomenon occurs make it possible to effectively prevent the occurrence of a stick-slip phenomenon.

CITATION LIST

Patent Literature

[Patent Literature 1] JP1-170513A
[Patent Literature 2] JP10-225712A

SUMMARY OF INVENTION

Technical Problem

An object of the present invention, which has been made to solve such problems of prior art as described above, is to provide a precursor detection method and a precursor detection device for detecting a precursor of a stick-slip phenomenon, and a method for cold drawing a pipe by using the precursor detection method.

Solution to Problem

Having conducted diligent studies to solve the above described problems, the present inventors have obtained a finding that in a stage prior to occurrence of a stick-slip phenomenon, which is accompanied by a dimensional defect of the pipe and generation of a sound, the plug vibrates along the drawing direction at a smaller amplitude than in when a stick-slip phenomenon occurs. Then, having investigated a method which allows the detection of such a small vibration of the plug before the occurrence of a stick-slip phenomenon, the inventors have obtained a finding that a load (tensile load) applied to the plug support bar, which is linked to the plug, in the drawing direction varies in response to the vibration of the plug even if it is a small vibration. Accordingly, they have found that a precursor of a stick-slip phenomenon can be detected based on the variation of the load applied to the plug support bar in the drawing direction.

It is considered, for the following reason, to be difficult to detect a precursor of a stick-slip phenomenon through the detection of a vibration by an AE sensor attached to the die according to Patent Literature 1.

It is inferred that an AE sensor attached to the die detects the vibration of the die, which is the primary detection object of the method according to Patent Literature 1, as well as small vibrations of the plug before the occurrence of a stick-slip phenomenon. However, since the AE sensor attached to the die detects not only small vibrations of the plug before the occurrence of a stick-slip phenomenon but also vibrations of the die, vibrations caused by the carriage that pulls the pipe, vibrations caused by other facilities in the surrounding, and vibrations of factory buildings, all together, it is difficult to distinguish a small vibration of the plug before the occurrence of a stick-slip phenomenon from other vibrations.

Moreover, it is considered, for the following reason, to be difficult to detect a precursor by the detection method of Patent Literature 2.

In the detection method of Patent Literature 2, the strain of the carriage which pulls the pipe is measured. The measurement result of the strain of the carriage is subject to effects of the vibrations of the carriage and other facilities etc, especially when the cold drawing is based on a chain system. For that reason, even if frequency analysis shown in FIG. 2 of Patent Literature 2 is performed, the effects of the noises caused by factors other than the strain of the carriage are large, and there is a risk that a precursor is misjudged. Further, when a precursor of a stick-slip phenomenon occurs, the pipe, which is being pulled by the carriage, is repeating an integral movement and slipping between itself and the plug, and thus the pipe is not always moved integrally with the plug so that the effects of the vibration of the plug will not directly appear in the strain of the carriage which pulls the pipe. Therefore, even if the strain of the carriage is measured, it is considered to be difficult to detect a small vibration, of the plug before the occurrence of a stick-slip phenomenon.

The present invention has been completed based on the above findings by the present inventors. That is, in order to solve the above described problems, the present invention provides a precursor detection method for detecting a precursor of a stick-slip phenomenon during a cold drawing of a pipe or tube by a drawing machine including a die, a plug provided in the die, and a plug support bar for supporting the plug, the precursor detection method of the stick-slip phenomenon comprising: a load measurement step of measuring a load applied to the plug support bar in the drawing direction, during a predetermined period from a measurement start point to a measurement end point after drawing is started; and a precursor detection step of detecting a precursor of the stick-slip phenomenon based on load measurement values obtained in the load measurement step.

In the present invention, the measurement start point and the measurement end point of the load measurement step are, for example, determined as follows.

An investigation is conducted in advance to acquire a time point after the start of drawing at which a precursor of a stick-slip phenomenon is likely to occur. When an occurrence distribution which is a distribution of the time point at which a precursor is likely to occur extends over a wide range, the measurement start point and the measurement end point of the load measurement step may be determined such that the load measurement step and the precursor detection step can be performed a plurality of times at arbitrary times during a period from the start point of drawing to the end point of drawing. That is, a plurality of pairs of the measurement start point and the measurement end point may be determined at arbitrary times during a period from the start point of drawing to the end point of drawing. Thus, determining a plurality of pairs of the measurement start point and the measurement end point during a period from the start point of drawing to the end point of drawing, and repeating the load measurement step and the precursor detection step will make it possible to expect that precursors are thoroughly detected. This period from the measurement start point to the measurement end point (hereafter, the period from the measurement start point to the measurement end point is also referred to as a load measurement time) is preferably as short as possible. This is because when a precursor of a stick-slip phenomenon occurs, it is possible to immediately detect the precursor by the precursor detection step and to take a preventive measure against the occurrence of a stick-slip phenomenon.

Further, if the occurrence distribution which is a distribution of the time point at which a precursor is likely to occur stays within a narrow range, supposing that the load measurement step and the precursor detection step are carried out one time for each, the measurement start point and the measurement end point of the load measurement step may be determined such that the occurrence distribution falls within a period from the measurement start point to the measurement end point. Moreover, when a precursor is detected during the load measurement time, the measurement end point is preferably made close to the time point at which drawing is started such that a preventive measure against the occurrence of a stick-slip phenomenon can be taken during a period until a stick-slip phenomenon occurs.

Furthermore, in the precursor detection step, when a precursor is detected by performing frequency analysis of load measurement values over a predetermined frequency band, the load measurement time is preferably determined to be as short as possible to improve the accuracy of detection. This is because when the precursor is detected in a long load measurement time and a short load measurement time, the proportion of the load measurement values relevant to a precursor with respect to the total load measurement values which are the targets of frequency analysis is larger when detection is performed within a short load measurement time.

The load applied to the plug support bar in the drawing direction, which is to be measured in the present invention, is not likely to be affected by vibrations caused by the carriage that pulls the pipe, vibrations caused by other facilities in the surrounding, and vibrations of factory buildings. This is because when the carriage that pulls the pipe, other facilities, and factory buildings vibrate, the plug support bar vibrates together with the base that fixes the rear edge thereof due to the vibrations, so that the entire plug support bar is simply displaced in the vibration direction without being accompanied by expansion and contraction. In this way, since the plug support bar will neither expand nor contract even when the carriage and others vibrate, there is no load generated in the drawing direction in the plug support bar. Therefore, the load applied to the plug support bar in the drawing direction is not likely to be affected by the vibrations caused by the carriage that pulls the pipe, vibrations caused by other facilities in the surrounding, and vibrations of factory buildings.

Moreover, since in the present invention, the load applied to the plug support bar, which is directly linked to the plug which is a vibration source, is measured, it is possible to detect a small vibration of the plug before the occurrence of a stick-slip phenomenon.

For the reasons described so far, it is considered to be possible to detect a precursor before the occurrence of a stick-slip phenomenon by the method of the present invention.

Preferably, in the precursor detection step, frequency analysis of load measurement values is performed over a predetermined frequency band, and it is judged that the precursor of the stick-slip phenomenon has occurred when a peak intensity of an obtained frequency spectrum by the frequency analysis exceeds a predetermined reference value.

In such a preferred method, the range of the frequency band in which frequency analysis of load measurement values is performed may be set by, for example, varying the drawing condition in advance to force a stick-slip phenomenon to occur, and performing frequency analysis of the load measurement values in a precursor period of the stick-slip phenomenon to investigate the frequency of the vibration of the plug in the precursor period. Moreover, the predetermined reference value of the peak intensity of frequency spectrum may also be set by investigating in advance the intensity of the frequency spectrum which is obtained from load measurement values in a precursor period of the stick-slip phenomenon which is forced to occur. Further, it may be arranged such that loads during cold drawing work are always measured at normal drawing conditions without forcing a stick-slip phenomenon to occur, and when a stick-slip phenomenon occurs, predetermined reference values for the range of the frequency band to be subjected to frequency analysis and the peak intensity of the frequency spectrum may be determined based on the load measurement values before the occurrence.

According to such a preferable method, since the occurrence of a precursor is judged by performing frequency analysis of load measurement values on a predetermined frequency band, the judgment becomes less likely to be affected by noises having frequencies other than those of the plug in a precursor period, and thus it can be expected that the occurrence of a precursor is accurately judged.

In order to solve the above described problems, the present invention also provides a method for cold drawing a pipe or tube, wherein when the precursor of the stick-slip phenomenon is detected by the precursor detection method according to claim 1 or 2, a drawing speed of the pipe or tube by the drawing machine is made to be reduced.

According to such an invention, since the drawing speed is reduced when a precursor of a stick-slip phenomenon is detected, it is possible to make the stick-slip phenomenon less likely to occur.

In order to solve the above described problems, the present invention further provides a precursor detection device for detecting a precursor of a stick-slip phenomenon during cold drawing a pipe or tube by a drawing machine including a die, a plug provided in the die, and a plug support bar for supporting the plug, the precursor detection device of the stick-slip phenomenon comprising: a load measurement section for measuring a load applied to the plug support bar in the drawing direction during a predetermined period from a measurement start point to a measurement end point after drawing is started; and a precursor detection section for detecting a precursor of the stick-slip phenomenon based on load measurement values measured by the load measurement section.

Advantageous Effects of Invention

According to the present invention, a precursor of a stick-slip phenomenon can be detected during cold drawing of a pipe.

BRIEF DESCRIPTION OF DRAWINGS

FIG. 4A is a diagram of the frequency spectrum obtained from frequency analysis of the load measurement values in the ordinary state shown in FIG. 3, and FIG. 4B is a diagram of the frequency spectrum obtained from frequency analysis of the load measurement values in the precursor state shown in FIG. 3.

FIG. 6A is a diagram of the frequency spectrum obtained from frequency analysis of the acceleration measurement values in the ordinary state shown in FIG. 5, and FIG. 6B is a diagram of the frequency spectrum obtained from frequency analysis of the acceleration measurement values in the precursor state shown in FIG. 5.

DESCRIPTION OF EMBODIMENTS

Hereafter, a precursor detection method of a stick-slip phenomenon relating to one embodiment of the present invention will be described with reference to the appended drawings.

Figure 1:
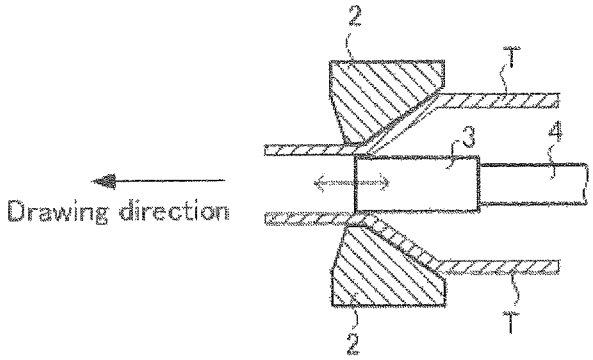
FIG. 1 is a diagram to illustrate a stick-slip phenomenon.
Figure 2:
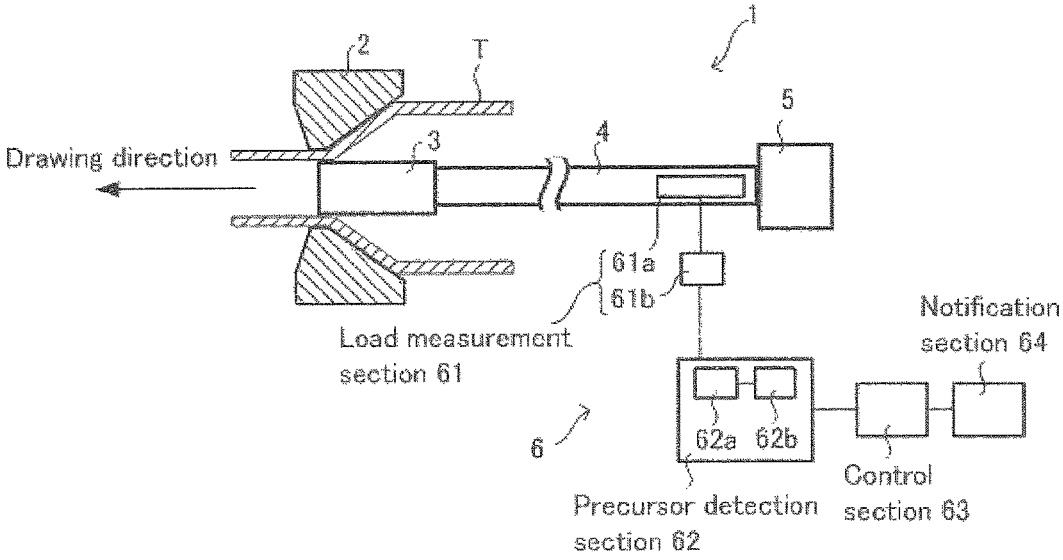
FIG. 2 is a schematic diagram showing one configuration example of a drawing machine and a precursor detection device for a stick-slip phenomenon to be used for the precursor detection method relating to one embodiment of the present invention.

FIG. 2 is a schematic diagram showing one configuration example of a drawing machine and a precursor detection device for a stick-slip phenomenon to be used for the precursor detection method relating to the present embodiment.

A drawing machine 1 for drawing a pipe (steel pipe) T includes a die 2, a plug 3 provided in the die 2, and a plug support bar 4 for supporting the plug 3. The plug 3 is provided at a front edge of the plug support bar 4, and a rear edge of the plug support bar 4 is fixed onto a base (not shown) of the drawing machine 1 with a fixing pin 5.

A precursor of a stick-slip phenomenon in the drawing machine 1 is detected by a precursor detection device 6.

The precursor detection device 6 includes a load measurement section 61 for measuring loads applied to the plug support bar 4 in the drawing direction (direction shown by an arrow in FIG. 2), and a precursor detection section 62 for detecting a precursor of a stick-slip phenomenon based on the load measurement value measured by the load measurement section 61. The precursor detection device 6 further includes a control section 63 for controlling the action of the precursor detection section 62 and the like, and a notification section 64 for notifying a detection of a precursor.

The load measurement section 61 includes a strain gauge 61*a* to be bonded to, for example, the plug support bar 4, and a load calculation section 61*b* for calculating a load applied to the plug support bar 4 from the amount of strain measured by the strain gauge 61*a*, wherein the load calculation section 61*b* transmits calculated load measurement values to the precursor detection section 62. The load measurement section 61 is not limited to the configuration as described above, and can utilize for example a load cell. In the present embodiment, description will be made on a case in which the load measurement section 61 includes the strain gauge 61*a* and the load calculation section 61*b* as described above.

The precursor detection section 62 includes, for example, a frequency analysis section 62*a* for performing frequency analysis of load measurement values measured by the load measurement section 61 over a predetermined frequency band, and a judgment section 62*b* for judging the occurrence of a precursor of a stick-slip phenomenon based on the frequency spectrum obtained by the frequency analysis.

The frequency analysis section 62*a* stores a range of frequency band for performing frequency analysis of load measurement values corresponding to drawing conditions. The range of frequency band in which frequency analysis of load measurement values is performed is set and stored by, for example, performing in advance frequency analysis of load measurement values in a precursor period of a stick-slip phenomenon, and investigating the frequency of the vibration of the plug 3 in the precursor period.

The judgment section 62*b* judges that a precursor of a stick-slip phenomenon has occurred when a peak intensity of the frequency spectrum obtained by the frequency analysis exceeds a predetermined reference value. The judgment section 62*b* stores the predetermined reference values, by which a judgment is made that a precursor has occurred, corresponding to drawing conditions. This predetermined reference values are set and stored by, for example, investigating in advance the intensity of the frequency spectrum obtained from the load measurement values in a precursor period of a stick-slip phenomenon.

When the precursor detection section 62 detects a precursor, the control section 63 causes the notification section 64 to notify that a precursor has been detected. The notification section 64 notifies the operator of the detection of a precursor by means of, for example, a sound, a voice, and/or a display.

Next, a method for detecting a precursor of a stick-slip phenomenon will be described.

A steel pipe T is set in the drawing machine 1 and the front edge of the steel pipe T is pulled by a carriage (not shown) to start drawing (starting step).

After drawing is started, the load (tensile load) applied to the plug support bar in the drawing direction is measured during a predetermined period from the measurement start point to the measurement end point (load measurement step).

The measurement start point and the measurement end point are determined, for example, as follows.

An investigation is conducted in advance to acquire a time point after the start of drawing at which a precursor of a stick-slip phenomenon is likely to occur. When an occurrence distribution which is a distribution of the time point at which a precursor is likely to occur extends over a wide range, the measurement start point and the measurement end point of the load measurement step may be determined such that the load measurement step and the precursor detection step can be performed a plurality of times at arbitrary times during a period from the start point of drawing to the end point of drawing. That is, a plurality of pairs of the measurement start point and the measurement end point may be determined at arbitrary times during a period from the start point of drawing to the end point of drawing. Thus, determining a plurality of pairs of the measurement start point and the measurement end point during a period from the start point of drawing to the end point of drawing, and repeating the load measurement step and the precursor detection step described below will make it possible to expect that precursors are thoroughly detected. This period from the measurement start point to the measurement end point is preferably as short as possible. This is because when a precursor of a stick-slip phenomenon occurs, it is possible to immediately detect the precursor by the precursor detection step and to take a preventive measure against the occurrence of a stick-slip phenomenon.

Further, if the occurrence distribution, which is a distribution of the time point at which a precursor is likely to occur, stays within a narrow range, supposing that the load measurement step and the precursor detection step are carried out one time for each, the measurement start point and the measurement end point of the load measurement step may be determined such that the occurrence distribution falls within a period from the measurement start point to the measurement end point. Moreover, when a precursor is detected during the load measurement time, the measurement end point is preferably made close to the time point at which drawing is started such that a preventive measure against the occurrence of a stick-slip phenomenon can be taken during a period until a stick-slip phenomenon occurs.

The measurement start point and the measurement end point which have been determined as described above are stored in the control section 63 in advance. When the time point at which the drawing machine 1 starts drawing is used as the reference for time measurement of the measurement start point and the measurement end point, a drawing start signal is transmitted from the drawing machine 1 to the control section 63 when the drawing machine 1 starts drawing, and the control section 63 counts the measurement start point and the measurement end point with reference to the time when the drawing start signal is received.

The load calculation section 61*b* calculates the load applied to the plug support bar 4 at a constant time interval from the amount of strain of the plug support bar 4, which is measured by the strain gauge 61*a*. Then, the load measurement values thus obtained by calculation are successively transmitted to the frequency analysis section 62*a*.

Next, a precursor of a stick-slip phenomenon is detected based on the load measurement values obtained in the load measurement step (precursor detection step).

The detection of a precursor based on the load measurement values is performed, for example, as follows.

The control section 63 causes the frequency analysis section 62*a* to perform frequency analysis. Specifically, frequency analysis of the load measurement values, which have been transmitted by the load calculation section 61*b* to the frequency analysis section 62*a* during a period from the measurement start point to the measurement end point, is performed for a predetermined frequency band. Then the judgment section 62*b* judges that a precursor of a stick-slip phenomenon has occurred when a peak intensity of the frequency spectrum, which is obtained by frequency analysis by the frequency analysis section 62*a*, exceeds a predetermined reference value.

When detecting a precursor by frequency analysis, the load measurement time, which is the period from the measurement start point to the measurement end point, is preferably determined to be as short as possible to improve the accuracy of detection. That is because when detecting the precursor with a long load measurement time and a short load measurement time, the proportion of the load measurement values relevant to the precursor with respect to all the load measurement values which are the targets of frequency analysis is larger when detection is performed within a short load measurement time. The load measurement time is set to, for example, 0.4 seconds or less.

Upon judging that a precursor of a stick-slip phenomenon has occurred, the judgment section 62*b* transmits a signal indicating the detection of a precursor, to the control section 63.

Figure 3:
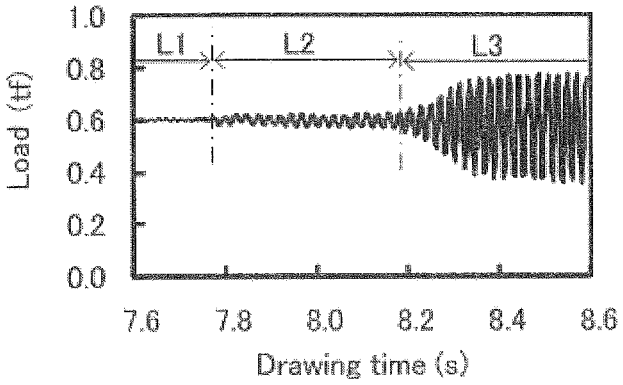
FIG. 3 is an exemplary transition diagram of measurement values of the load applied to the plug support bar in the drawing direction, which are measured by the precursor detection device.

FIG. 3 is an exemplary transition diagram of measurement values of the load applied to the plug support bar 4 in the drawing direction, which are measured by the precursor detection device 6 (the load measurement section 61). The abscissa indicates the drawing time (the elapsing time from the drawing start point), and the ordinate indicates the load applied to the plug support bar 4 in the drawing direction. This transition diagram shows load measurement values obtained at the following drawing conditions.

(1) Pipe material: Bearing steel (SUJ2: JIS G 4805), (2) Dimensions before drawing: Outer diameter 45.00 mm, wall thickness 5.90 mm, (3) Dimensions after drawing: Outer diameter 34.30 mm, wall thickness 5.20 mm, (4) Outer diameter of plug support bar: 19 mm, (5) Drawing speed: 40 m/min.

In the example shown in FIG. 3, as time elapses, transitions are made from an ordinary state L1 to a precursor state L2 in which a precursor of a stick-slip phenomenon has occurred, and further to a stick-slip phenomenon occurring state L3 in which a stick-slip phenomenon has occurred.

Although the variation range of the load applied to the plug support bar 4 is about 0.01 (tf) in the ordinary state L1, it slightly increases to about 0.05 (tf) in the precursor state L2, and further increases to about 0.6 (tf) in the stick-slip phenomenon occurring state L3.

Figure 4A:
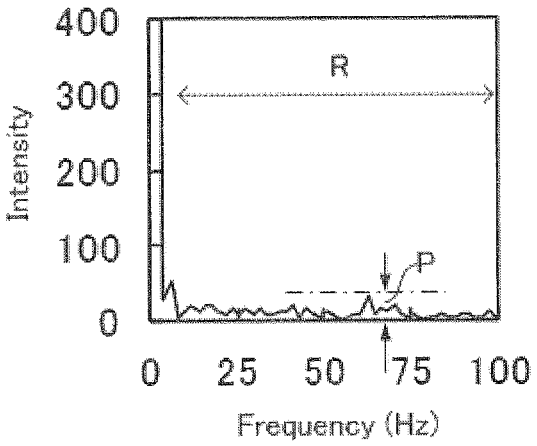
FIGS. 4A and 4B are diagrams of frequency spectrum.
Figure 4B:
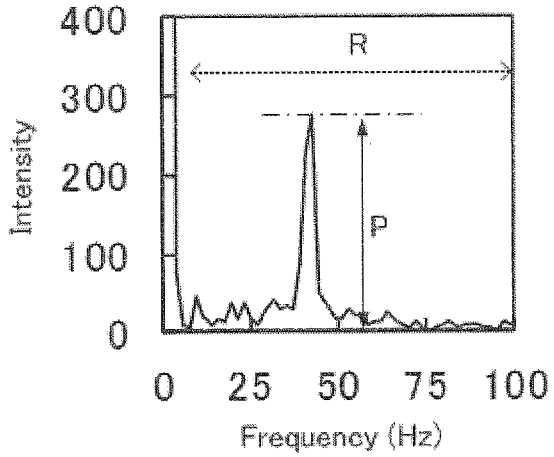

FIGS. 4A and 4B are diagrams of frequency spectrum obtained by performing frequency analysis of the load measurement values shown in FIG. 3. FIG. 4A is a diagram of the frequency spectrum obtained from frequency analysis of the load measurement values in the ordinary state L1, and FIG. 4B is a diagram of the frequency spectrum obtained from frequency analysis of the load measurement values in the precursor state L2. Fourier analysis is used for the frequency analysis here.

While the range of the frequency band to be subjected to frequency analysis is determined dependent on the outer diameter of the plug support bar 4, the tensile load, the material of the pipe T, the outer diameters and wall thicknesses of the pipe T before and after drawing, the drawing speed, and the like; in the case in which the pipe T is a steel pipe, for example, the lower limit may be set to a range of not less than 10 Hz, and the upper limit to a range of not more than 600 Hz. Thereby, a precursor can be detected.

In the present embodiment, as shown in FIGS. 4A and 4B, the range R of frequency band to be subjected to frequency analysis is 10 to 100 Hz. While the peak intensity P of frequency spectrum in the range of 10 to 100 Hz is not more than 100 Hz in the ordinary state L1 shown in FIG. 4A, it increases to not less than 250 in the precursor state L2 shown in FIG. 4B. Thus, setting a reference value of peak intensity to, for example, 100 will allow a precursor to be detected with ease.

Upon receiving a signal indicating that a precursor is detected from the judgment section 62*b*, the control section 63 causes a notification section 64 to make a notification that the precursor has been detected.

In this way, in the present embodiment, it is possible to detect a precursor of a stick-slip phenomenon based on the measurement values of the load applied to the plug support bar in the drawing direction.

Next, description will be made on a case in which in contrast to the present invention, a vibration meter is attached to the plug support bar 4 and the vibration (acceleration) of the plug support bar 4 in the drawing direction is measured by the vibration meter. As the vibration meter, for example, an AE sensor similar to one described in Patent Literature 1 may be used.

Figure 5:
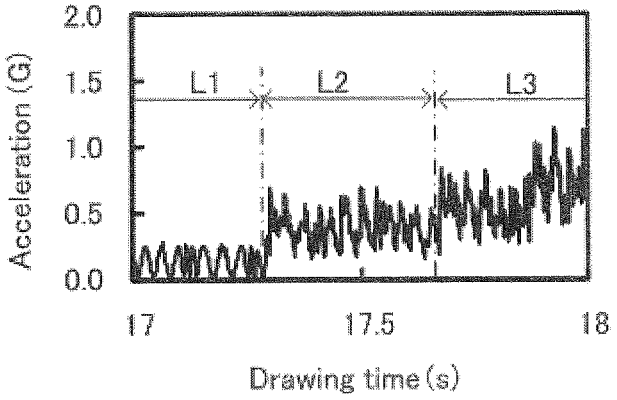
FIG. 5 is an exemplary transition diagram of acceleration applied to the plug support bar in the drawing direction, which is measured by the vibration meter.

FIG. 5 is an exemplary transition diagram of acceleration applied to the plug support bar 4 in the drawing direction, which is measured by the vibration meter. The abscissa indicates the drawing time (the elapsing time from the drawing start point), and the ordinate indicates the acceleration applied to the plug support bar 4 in the drawing direction. The transition diagram of FIG. 5 is obtained at the same drawing conditions as those in the case of FIG. 3.

In the example shown in FIG. 5, the acceleration increases in the precursor state L2 compared to in the ordinary state M, and further increases in the stick-slip phenomenon occurring state L3. However, these acceleration measurement values are those obtained in a case in which there is no vibration source other than the drawing machine 1. When there are other vibration sources, since the acceleration is affected by the vibrations thereof, the difference in acceleration among in the ordinary state L1, in the precursor state L2, and in the stick-slip phenomenon occurring state L3 decreases. Therefore, it is difficult to detect a precursor before the occurrence of a stick-slip phenomenon from the magnitude of acceleration.

Figure 6A:
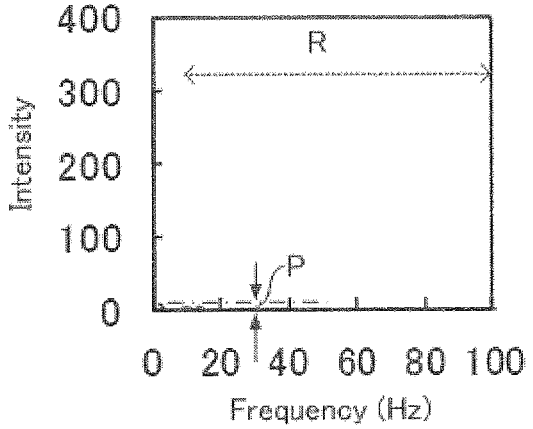
FIGS. 6A and 6B are diagrams of frequency spectrum.
Figure 6B:
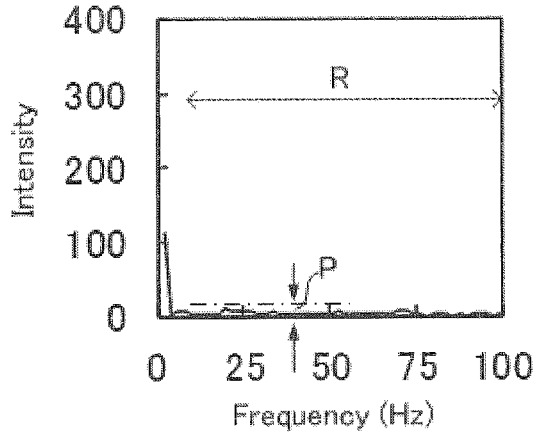

FIGS. 6A and 6B are diagrams of frequency spectrum obtained by performing frequency analysis of the acceleration measurement values shown in FIG. 5. FIG. 6A is a diagram of the frequency spectrum obtained from frequency analysis of the acceleration measurement values in the ordinary state L1, and FIG. 6B is a diagram of the frequency spectrum obtained from frequency analysis of the acceleration measurement values in the precursor state L2. Fourier analysis is used for the frequency analysis here.

The range R of frequency band to be subjected to frequency analysis is 10 to 100 Hz which is the same as in the case of the load shown in FIGS. 4A and 4B described above. There is no significant difference in the peak intensity P of frequency spectrum in the range of 10 to 100 Hz between in the ordinary state L1 shown in FIG. 6A and in the precursor state L2 shown in FIG. 6B. Therefore, it is also difficult to detect a precursor before the occurrence of a stick-slip phenomenon from the frequency spectrum obtained by performing frequency analysis of acceleration measurement values.

In the present embodiment, the configuration may be such that when the precursor detection section 62 detects a precursor, the control section 63 transmits a precursor detection signal, which indicates that a precursor has been detected, to the drawing machine 1, and the drawing machine 1 that has received the precursor detection signal reduces the drawing speed.

That is, when the judgment section 62*b* judges that a precursor of a stick-slip phenomenon has occurred in the above described precursor detection step, the control section 63 transmits a precursor detection signal to the drawing machine 1, and the drawing machine 1 that has received the precursor detection signal automatically reduces the drawing speed (speed reduction step).

Moreover, the arrangement may be such that the operator manually reduces the drawing speed in response to a notification by the notification section 64 when a precursor is detected.

In any way, since the drawing speed is reduced when a precursor of a stick-slip phenomenon is detected, it is possible to make a stick-slip phenomenon be not likely to occur.

While, in the present embodiment, a precursor of a stick-slip phenomenon is detected based on a peak intensity of the frequency spectrum obtained by performing frequency analysis of measured values of the load applied to the plug support bar 4, the arrangement may be such that the detection is performed based on the load measurement value itself without performing frequency analysis. For example, since the variation range of the load measurement value becomes larger in the precursor state L2 compared with in the ordinary state L1 as shown in FIG. 3, it may be arranged such that a precursor is detected based on the magnitude of the variation range of the load measurement value. Specifically, it may be arranged such that a reference value of variation range of load measurement values at which it is judged that a precursor of a stick-slip phenomenon has occurred is stored in the judgment section 62*b* of the precursor detection section 62, and when the variation range of the load measurement value exceeds the reference value, the judgment section 62*b* judges that a precursor of a stick-slip phenomenon has occurred.

The load applied to the plug support bar in the drawing direction, which is to be measured in the present embodiment, is not likely to be affected by vibrations caused by the carriage that pulls the steel pipe, vibrations caused by other facilities in the surrounding, and vibrations of factory buildings. This is because when the carriage that pulls the pipe, other facilities, and factory buildings vibrate, the plug support bar vibrates together with the base that fixes the rear edge thereof due to the vibrations, so that the entire plug support bar is simply displaced in the vibration direction without being accompanied by expansion and contraction. In this way, since the plug support bar will neither expand nor contract even when the carriage and others vibrate, there is no load generated in the drawing direction in the plug support bar. Therefore, the load applied to the plug support bar in the drawing direction is not likely to be affected by the vibrations caused by the carriage that pulls the steel pipe, vibrations caused by other facilities in the surrounding, and vibrations of factory buildings.

Moreover, since in the present embodiment, the load applied to the plug support bar, which is directly linked to the plug which is a vibration source, is measured, it is possible to detect a small vibration of the plug before the occurrence of a stick-slip phenomenon.

For the reasons described so far, it is considered to be possible to detect a precursor before the occurrence of a stick-slip phenomenon by the method of the present invention.

Particularly, performing frequency analysis of load measurement values for a predetermined frequency band as in the present embodiment, and judging the occurrence of a precursor based on the obtained peak intensity of the frequency spectrum thus obtained will make the judgment becomes less likely to be affected by noises having frequencies other than those of the plug in a precursor period, and thus it can be expected that the occurrence of a precursor is accurately judged.

REFERENCE SIGNS LIST

1 drawing machine
2 die
3 plug
4 plug support bar
6 precursor detection device
61 load measurement section
62 precursor detection section
63 control section
T pipe (steel pipe)

The invention claimed is:

1. A precursor detection method for detecting a precursor of a stick-slip phenomenon during a cold drawing of a pipe or tube by a drawing machine including a die, a plug provided in the die, and a plug support bar for supporting the plug, the precursor detection method of the stick-slip phenomenon comprising:

a load measurement step of measuring a load applied to the plug support bar in the drawing direction, during a predetermined period from a measurement start point to a measurement end point after drawing is started; and a precursor detection step of detecting a precursor of the stick-slip phenomenon before an occurrence of the stick-slip phenomenon, based on load measurement values obtained in the load measurement step, wherein in the precursor detection step, frequency analysis of load measurement values is performed over a predetermined frequency band, and it is judged that the precursor of the stick-slip phenomenon has occurred when a peak intensity of an obtained frequency spectrum by the frequency analysis exceeds a predetermined reference value.

2. A method for cold drawing a pipe or tube, comprising cold drawing a pipe or tube by a drawing machine including a die, a plug provided in the die, and a plug support bar for supporting the plug; and detecting a precursor of a stick-slip phenomenon by the precursor detection method according to claim 1, wherein when the precursor of the stick-slip phenomenon is detected, a drawing speed of the pipe or tube by the drawing machine is made to be reduced.

3. A precursor detection device for detecting a precursor of a stick-slip phenomenon during cold drawing a pipe or tube by a drawing machine including a die, a plug provided in the die, and a plug support bar for supporting the plug, the precursor detection device of the stick-slip phenomenon comprising:

a load measurement section for measuring a load applied to the plug support bar in the drawing direction during a predetermined period from a measurement start point to a measurement end point after drawing is started; and a precursor detection section connected to the load measurement section for detecting a precursor of the stick-slip phenomenon before an occurrence of the stick-slip phenomenon, based on load measurement values measured by the load measurement section, wherein the load measurement section includes a strain gauge bonded to the plug support bar and a load calculation section connected to the strain gauge; or a load cell, and the precursor detection section includes a frequency analysis section connected to the load measurement section for performing frequency analysis of load measurement values measured by the load measurement section over a predetermined frequency band; and a judgment section connected to the frequency analysis section for judging that the precursor of the stick-slip phenomenon has occurred when a peak intensity of the frequency spectrum obtained by the frequency analysis section exceeds a predetermined reference value.

* * * * *